US009054429B2

(12) United States Patent
Kashiwagi et al.

(10) Patent No.: US 9,054,429 B2
(45) Date of Patent: Jun. 9, 2015

(54) ANTENNA APPARATUS AND ELECTRONIC DEVICE INCLUDING ANTENNA APPARATUS

(71) Applicants: Ippei Kashiwagi, Fuchu (JP); Hiroyuki Hotta, Ome (JP)

(72) Inventors: Ippei Kashiwagi, Fuchu (JP); Hiroyuki Hotta, Ome (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 168 days.

(21) Appl. No.: 13/719,707

(22) Filed: Dec. 19, 2012

(65) Prior Publication Data

US 2013/0257681 A1 Oct. 3, 2013

(30) Foreign Application Priority Data

Mar. 30, 2012 (JP) ..... 2012-082411

(51) Int. Cl.

| | |
|---|---|
| ***H01Q 1/24*** | (2006.01) |
| ***H01Q 21/28*** | (2006.01) |
| ***H01Q 21/30*** | (2006.01) |
| *H01Q 1/22* | (2006.01) |
| *H01Q 9/42* | (2006.01) |

(52) U.S. Cl.

CPC ..... *H01Q 21/28* (2013.01); *H01Q 1/2266* (2013.01); *H01Q 9/42* (2013.01); *H01Q 21/30* (2013.01)

(58) Field of Classification Search

CPC ..... H01Q 1/2266; H01Q 21/28; H01Q 21/30; H01Q 5/0024

USPC ..... 343/702, 700 MS, 848

See application file for complete search history.

(56) References Cited

U.S. PATENT DOCUMENTS

| | | | | |
|---|---|---|---|---|
| 7,808,438 | B2 * | 10/2010 | Schlub et al. | 343/702 |
| 7,916,089 | B2 * | 3/2011 | Schlub et al. | 343/702 |
| 8,130,169 | B2 * | 3/2012 | Chou et al. | 343/905 |
| 2005/0266904 | A1 | 12/2005 | Kitaji et al. | |
| 2006/0063494 | A1 | 3/2006 | Zhang et al. | |
| 2011/0012792 | A1 | 1/2011 | Krenz et al. | |

FOREIGN PATENT DOCUMENTS

| | | |
|---|---|---|
| JP | 2001-177330 | 6/2001 |
| JP | 2005-347791 | 12/2005 |
| JP | 2007013258 | 1/2007 |
| JP | 2010045698 | 2/2010 |

(Continued)

OTHER PUBLICATIONS

Japanese Patent Application No. 2012-082411, First Office Action, mailed Jun. 18, 2013, (with English Translation).

(Continued)

*Primary Examiner* — Hoang V Nguyen

(74) *Attorney, Agent, or Firm* — Blakely Sokoloff Taylor & Zafman LLP

(57) ABSTRACT

According to one embodiment, an antenna apparatus includes a first antenna unit disposed along a side of a ground pattern, a second antenna unit disposed along the side of the ground pattern so as to be juxtaposed with the first antenna unit, a first RF cable configured to connect the first antenna unit and the radio circuit unit, and a second RF cable configured to connect the second antenna unit and the radio circuit unit. The first RF cable and the second RF cable are routed from the first antenna unit and the second antenna unit in an arrangement direction of the first antenna unit and the second antenna unit so as to be parallel to each other, with the first RF cable being disposed so as to pass over the ground pattern.

17 Claims, 6 Drawing Sheets

(56) References Cited

FOREIGN PATENT DOCUMENTS

| | | |
|---|---|---|
| JP | 2010057022 | 3/2010 |
| JP | 2010-193462 | 9/2010 |

OTHER PUBLICATIONS

Japanese Patent Application No. 2012-82411; Situation Report on Accelerated Examination; Submitted Mar. 8, 2013 (English Translation).

* cited by examiner

<VSWR characteristics of embodiment>

<VSWR characteristics when RF cable is disposed on single-band antenna>

<Radiation efficiency characteristic of embodiment>

<Radiation efficiency characteristic when RF cable is disposed on single-band antenna>

<VSWR characteristics of embodiment>

<VSWR characteristic of reference example>

ANTENNA APPARATUS AND ELECTRONIC DEVICE INCLUDING ANTENNA APPARATUS

CROSS-REFERENCE TO RELATED APPLICATIONS

This application is based upon and claims the benefit of priority from Japanese Patent Application No. 2012-082411, filed Mar. 30, 2012, the entire contents of which are incorporated herein by reference.

FIELD

Embodiments described herein relate generally to an antenna apparatus and an electronic device including the antenna apparatus.

BACKGROUND

Various kinds of electronic devices have been developed, which make personal computers and television terminals incorporate radio interfaces using wireless local area network (LAN), WiMAX®, ultra-wideband (UWB), Bluetooth®, and the like to download contents and various kinds of data from Web sites and the like via the radio interfaces.

As an antenna apparatus used for the above radio interface, an antenna apparatus for implementing spatial diversity and multiple-input multiple-output (MIMO) is available. Spatial diversity and MIMO use a plurality of antennas arranged side by side. For this reason, it is necessary to ensure a larger space to accommodate the antenna apparatus in an electronic device than when using one antenna. On the other hand, an electronic device such as a personal computer or a tablet computer has a limited surplus space in the housing because of a reduction in the thickness of the housing and high-density packing of circuit components. For this reason, there has been proposed an electronic device including a plurality of antennas juxtaposed on a portion of a frame-type housing which supports a display.

In an electronic device having this arrangement, however, RF cables such as coaxial cables are arranged along the frame of the housing to connect the respective antennas and the radio circuit. For this reason, if, for example, two antennas are juxtaposed, an RF cable routed from one antenna is inevitably wired on or near the other antenna. In such a case, the other antenna is influenced by the RF cable wired on or near it. As a result, the resonant frequency may shift from a desired value, or desired antenna efficiency may not be obtained.

BRIEF DESCRIPTION OF THE DRAWINGS

A general architecture that implements the various features of the embodiments will now be described with reference to the drawings. The drawings and the associated descriptions are provided to illustrate the embodiments and not to limit the scope of the invention.

DETAILED DESCRIPTION

Various embodiments will be described hereinafter with reference to the accompanying drawings.

In general, according to one embodiment, an antenna apparatus provided in an electronic device includes a radio circuit unit and a ground pattern which forms a ground potential. The apparatus includes a first antenna unit disposed along a side of the ground pattern, a second antenna unit disposed along the side of the ground pattern so as to be juxtaposed with the first antenna unit, a first RF cable configured to connect the first antenna unit and the radio circuit unit, and a second RF cable configured to connect the second antenna unit and the radio circuit unit. The first antenna unit resonates in a first frequency band and a second frequency band. The second antenna unit resonates in the second frequency band. The first RF cable and the second RF cable are routed from the first antenna unit and the second antenna unit in an arrangement direction of the first antenna unit and the second antenna unit so as to be parallel to each other, with the first RF cable being disposed so as to pass over the ground pattern.

According to this embodiment, the first RF cable is routed out upon passing over a region formed by setting back the second antenna unit, i.e., over the ground pattern, without passing over the second antenna unit. This can suppress the influence of the first RF cable on the second antenna unit, thereby suppressing the occurrence of unnecessary resonance and a resonant frequency shift.

That is, this embodiment can provide an antenna apparatus which improves the frequency characteristic and radiation efficiency by reducing the influence of RF cables on the antenna even if the installation space of the antenna and RF cables is limited, and an electronic device including the antenna apparatus.

First Embodiment

Figure 1:
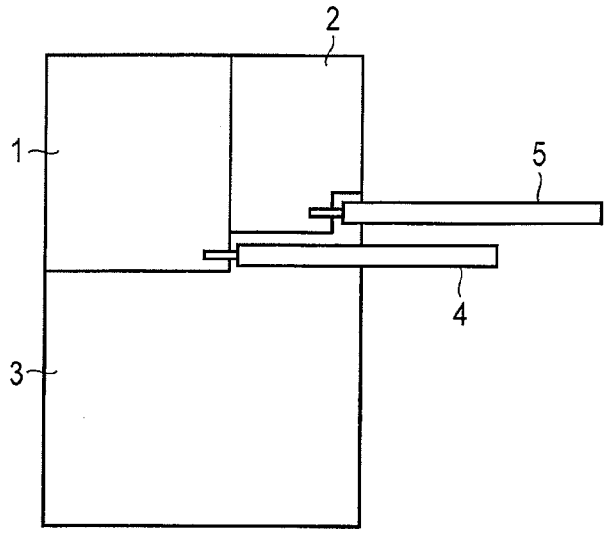
FIG. 1 is a view showing the schematic arrangement of an antenna apparatus according to the first embodiment.

FIG. 1 is a view showing the schematic arrangement of an antenna apparatus according to the first embodiment.

The antenna apparatus includes a dual-band antenna unit 1 serving as the first antenna unit and a single-band antenna unit 2 serving as the second antenna unit. The dual-band antenna unit 1 and the single-band antenna unit 2 are arranged along one side of a ground pattern 3 provided for an electronic device.

Figure 2:
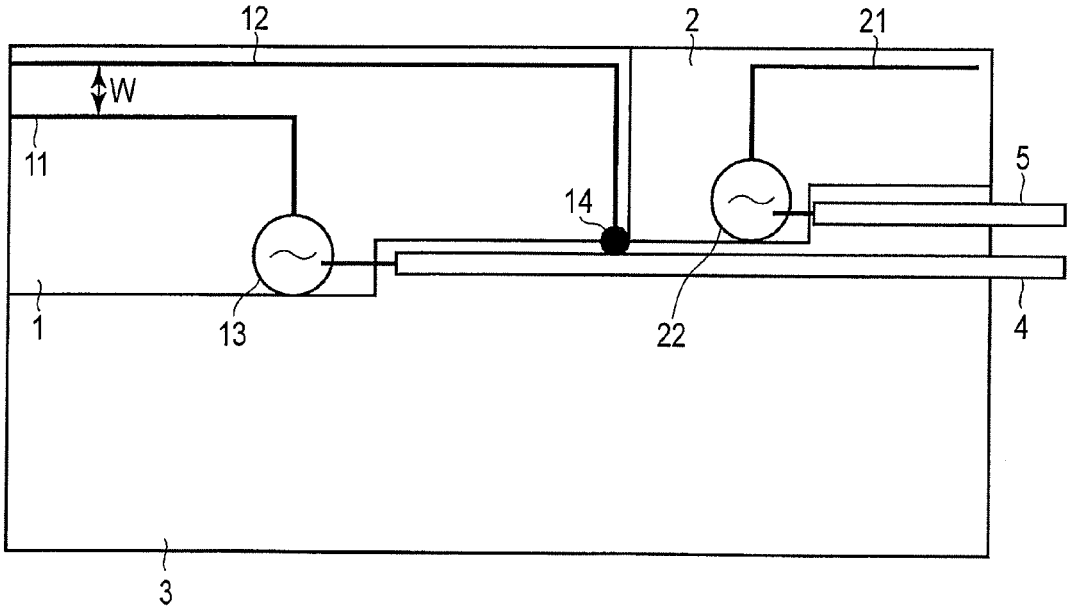
FIG. 2 is a view showing one concrete example of the antenna apparatus shown in FIG. 1.

As shown in FIG. 2, for example, the dual-band antenna unit 1 includes a first antenna element 11, a second antenna element 12, a first feed terminal 13, and a ground terminal 14.

The first antenna element 11 is formed from an L-shaped linear element, with the proximal end portion being connected to the first feed terminal 13, and the distal end portion being open. The second antenna element 12 is formed from an L-shaped linear element, with the proximal end portion being connected to the ground terminal 14, and the distal end portion being open. That is, the first antenna element 11 operates as a monopole element, and the second antenna element 12 operates as a parasitic element.

A portion, of the second antenna element 12, which extends from its intermediate portion to its distal end portion, is parallel to the first antenna element 11 so as to be adjacent to it through a distance W. With this arrangement, the second antenna element 12 is capacitively coupled to the first antenna element 11. The element lengths of the first and second antenna elements 11 and 12 are set so as to make them resonate in different first and second frequency bands f1 and f2. For example, the first and second frequency bands f1 and f2 are set to, for example, a 2-GHz band and 5-GHz band, respectively.

The single-band antenna unit 2 includes a third antenna element 21 and a second feed terminal 22. The third antenna element 21 is formed from an L-shaped linear element, with the proximal end portion being connected to the second feed terminal 22 and the distal end portion being open. The element length of the third antenna element 21 is set so as to make it resonate in the second frequency band f2 (5-GHz band).

The dual-band antenna unit 1 and single-band antenna unit 2 described above operate as a multiple-input multiple-output (MIMO) antenna in the second frequency band (5-GHz band).

The position of the contact side between the single-band antenna unit 2 and the ground pattern 3 is above the position of the contact side between the dual-band antenna unit 1 and the ground pattern 3 in FIGS. 1 and 2. Note that the dual-band antenna unit 1 may be formed such that part of the contact side between the dual-band antenna unit 1 and the ground pattern 3 is set back depending on the position of the first feed terminal 13, as exemplified by FIG. 2.

One end of a first RF cable 4 which connects the dual-band antenna unit 1 to a radio circuit (not shown) is connected to the first feed terminal 13, and the other end is routed out through the region above the ground pattern 3. This region is formed by setting back the position of the single-band antenna unit 2.

One end of a second RF cable 5 which connects the single-band antenna unit 2 and a radio circuit (not shown) is connected to the second feed terminal 22, and the other end is routed out in the same direction so as to be parallel to the first RF cable 4.

With this arrangement, the first RF cable 4 is routed out upon passing over the region formed by setting back the single-band antenna unit 2, i.e., over the ground pattern 3, without passing over the single-band antenna unit 2. This makes it possible to suppress the influence of the first RF cable 4 on the single-band antenna unit 2, thus suppressing the occurrence of unnecessary resonance and a resonant frequency shift.

Figure 3:
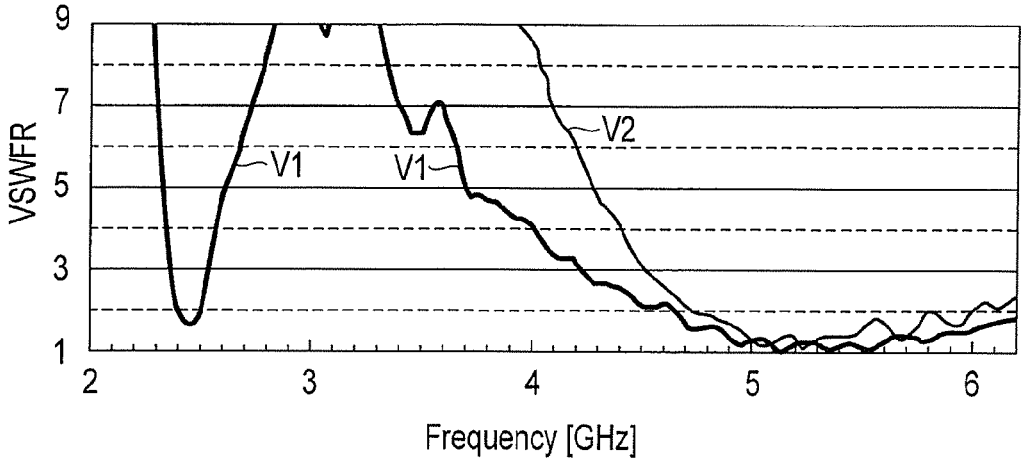
FIG. 3 is a graph showing the VSWR characteristics obtained by the antenna apparatus shown in FIG. 1.

FIG. 3 shows an example of the frequency characteristics of voltage standing wave ratio (VSWR) of the dual-band antenna unit 1 and single-band antenna unit 2. Referring to FIG. 3, reference symbol V1 denotes the VSWR characteristic of the dual-band antenna unit 1; and V2, the VSWR characteristic of the single-band antenna unit 2. As shown in FIG. 3, the occurrence of unnecessary resonance is suppressed.

Figure 4:
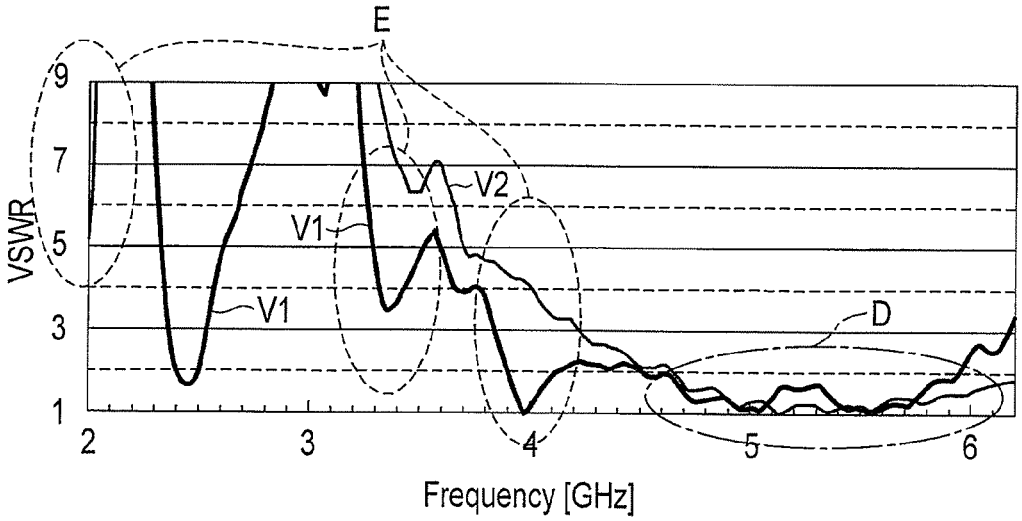
FIG. 4 is a graph showing the VSWR characteristics obtained by a reference example with RF cables being arranged on a single-band antenna.

Assume that the first RF cable 4 is wired on the single-band antenna unit 2. In this case, for example, as shown in FIG. 4, unnecessary resonances E and a frequency shift D occur in the VSWR characteristics of the single-band antenna unit 2 because of the influence of the first RF cable 4. This makes it impossible to obtain desired antenna characteristics.

In addition, in the first embodiment, the first and second frequency bands f1 and f2 are respectively set to a 2-GHz band and 5-GHz band. That is, the relationship between the first and second frequency bands is set to f1<f2. This can improve the efficiency near the low-resonant-frequency band f1.

Figure 5:
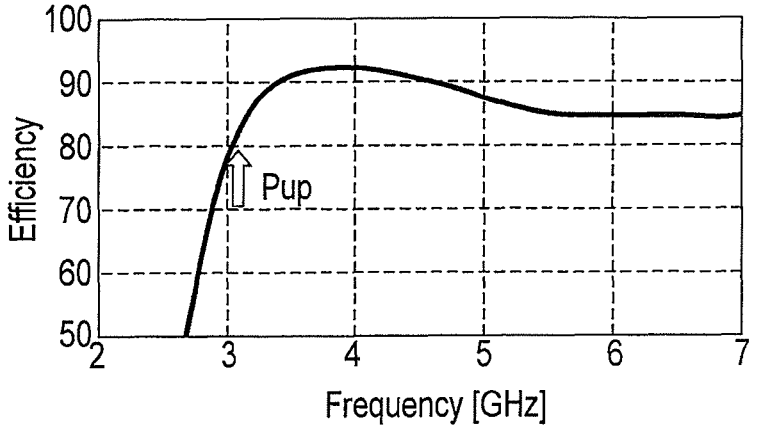
FIG. 5 is a graph showing the radiation efficiency characteristic obtained by the antenna apparatus shown in FIG. 1.
Figure 6:
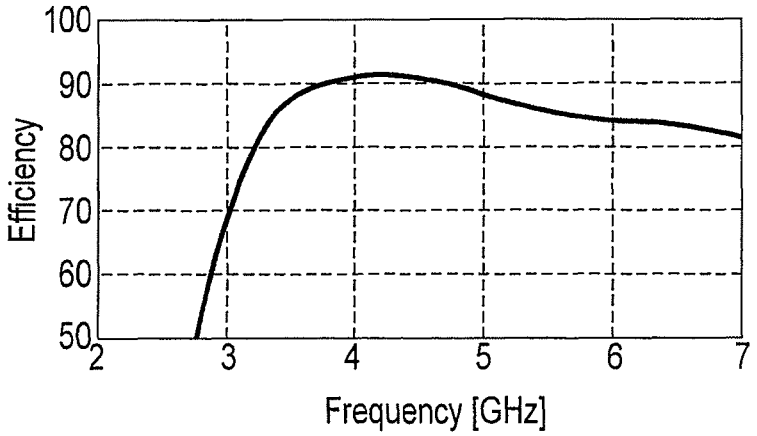
FIG. 6 is a graph showing the radiation efficiency characteristics obtained by a reference example having RF cables arranged on a single-band antenna.

FIG. 5 shows an example of the radiation efficiency analysis result obtained without any consideration of a mismatch loss. In contrast to this, FIG. 6 shows the frequency characteristic of radiation efficiency obtained when the first RF cable 4 is routed out in a direction opposite to the second RF cable 5 in FIG. 1. As is obvious from the comparison between the characteristics shown in FIGS. 5 and 6, the first embodiment improves the radiation efficiency in a low-frequency band (near 3 GHz in this case) by Pup=10%.

In the first embodiment, as shown in FIG. 2, the dual-band antenna unit 1 is constituted by the first antenna element 11 formed from a monopole element and the second antenna element 12 formed from a parasitic element, and the second antenna element 12 is capacitively coupled to the first antenna element 11. With this arrangement, the second antenna element 12 operates as a stub, thus suppressing coupling between the dual-band antenna unit 1 and the single-band antenna unit 2 in high-resonant-frequency band f2=5 GHz. That is, this can improve isolation between the dual-band antenna unit 1 and the single-band antenna unit 2.

Figure 7:
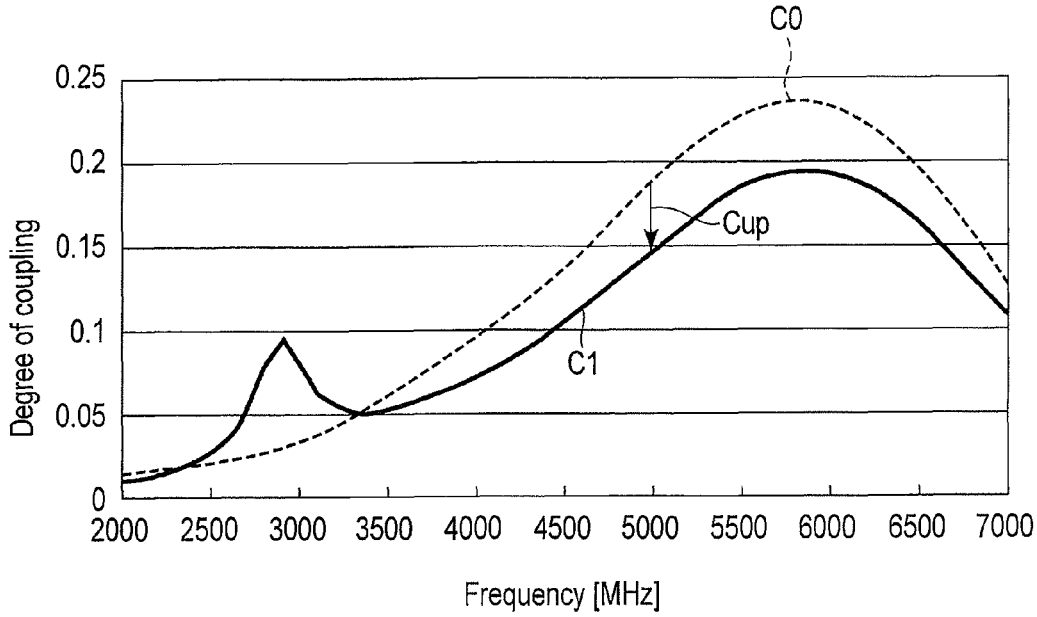
FIG. 7 is a graph showing the frequency characteristic of a degree of coupling obtained by the antenna apparatus shown in FIG. 2.

FIG. 7 shows the results obtained by theoretical analysis of the frequency characteristics of a degree of coupling using an electromagnetic field analysis tool. As shown in FIG. 7, it is possible to reduce a degree of coupling C1 with the second antenna element 12 by Cup near the resonant band f2 (5 GHz) as compared with a degree of coupling CO without the second antenna element 12.

The second embodiment provides the second antenna element 12 so as to make the second antenna element 12 operate as a dual-band antenna which operates in a 2-GHz band at the first feed terminal 13. This makes it possible to improve the gross efficiency in resonant-frequency band f1=2 GHz.

Figure 8:
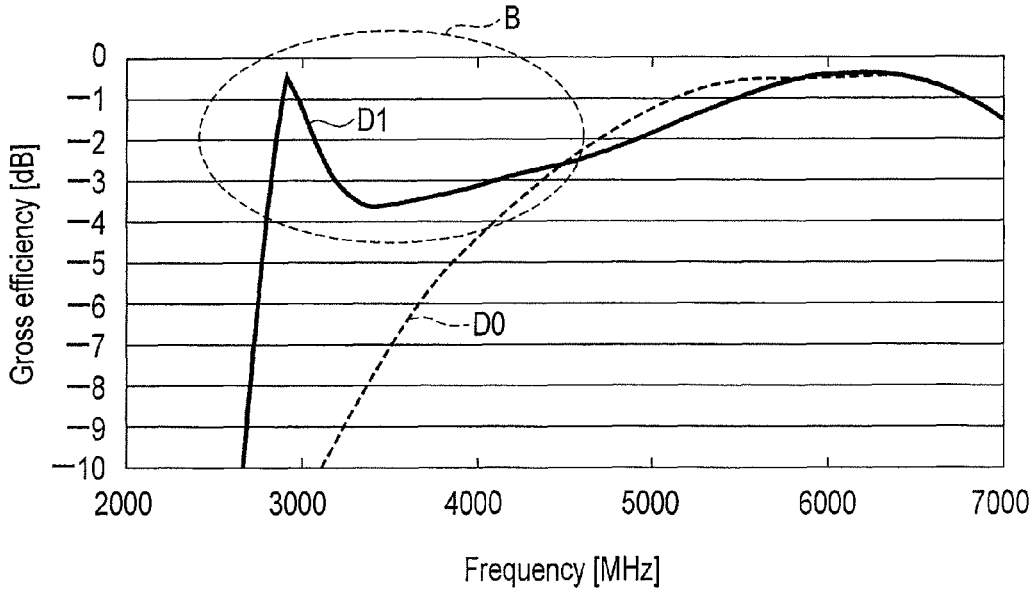
FIG. 8 is a graph showing the frequency characteristic of gross efficiency obtained by the antenna apparatus shown in FIG. 2.

FIG. 8 shows the results obtained by theoretical analysis of the frequency characteristics of gross efficiency using an electromagnetic field analysis tool. As shown in FIG. 8, it is possible to greatly improve a gross efficiency D1 with the second antenna element 12 at a position near the low-frequency band f1 (3 GHz in this case) as compared with a gross efficiency D0 without the second antenna element 12.

Second Embodiment

Figure 9:
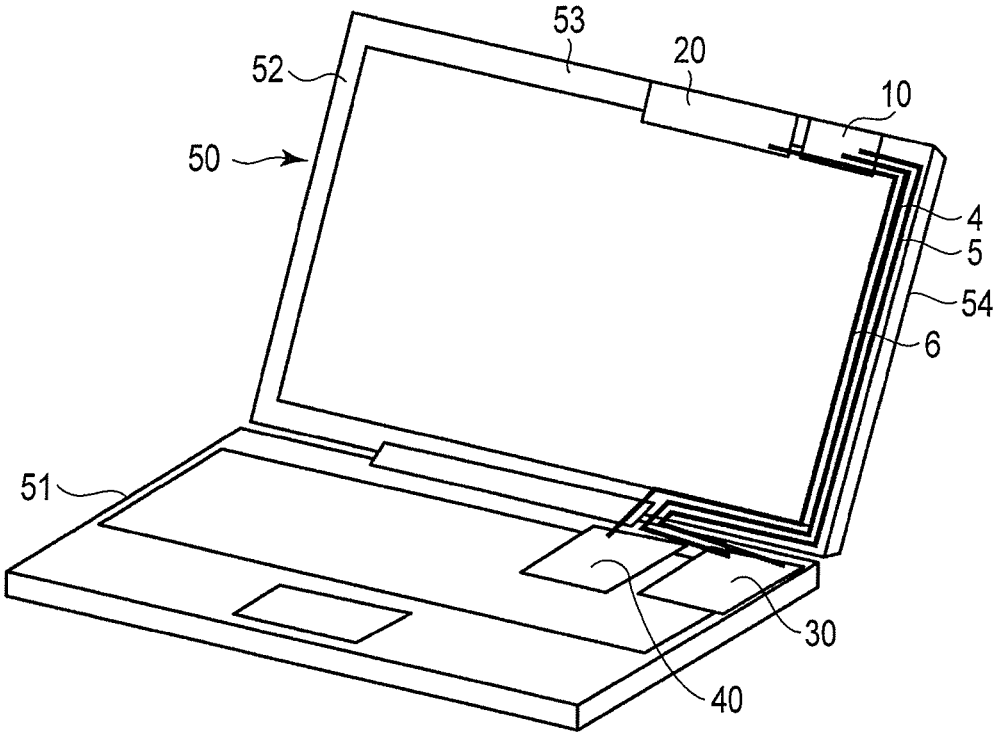
FIG. 9 is a perspective view showing the arrangement of an electronic device according to the second embodiment.

FIG. 9 is a perspective view showing the arrangement of an electronic device including an antenna apparatus according to the second embodiment. This electronic device is formed from a notebook computer. Note that the electronic device may be a portable terminal such as a navigation terminal, cellular phone, smart phone, personal digital assistant (PDA), or tablet computer instead of a notebook computer or television receiver.

First and second radio circuits 30 and 40 are arranged in a lower housing 51 of a notebook computer. An upper housing 52 has a frame-like shape to support a display. A MIMO antenna apparatus 10 and a second antenna apparatus 20 are juxtaposed on an upper side portion 53 of the upper housing 52 having the frame-like shape described above. The layout relationship between the MIMO antenna apparatus 10 and the second antenna apparatus 20 is set such that the MIMO antenna apparatus 10 is located near an end portion of the upper side portion 53 of the upper housing 52, and the second antenna apparatus 20 is located near the middle of the upper side portion 53 of the upper housing 52.

The MIMO antenna apparatus 10 is used, for example, for transmission/reception with respect to a wireless local area network (LAN), and has the same arrangement as that of the antenna apparatus shown in FIG. 1 or 2. That is, the MIMO antenna apparatus 10 has a dual-band antenna unit 1 and a single-band antenna unit 2 arranged side by side, and first and second RF cables 4 and 5 are routed from the antenna units 1 and 2 in the same direction so as to be parallel to each other. A side of the single-band antenna unit 2 which is in contact with a ground pattern 3 is set back, and the first RF cable 4 is wired in the region formed by setting back the side. The first and second RF cables 4 and 5 are wired along a side portion 54 of the upper housing 52 and are then connected to the first radio circuit 30.

On the other hand, the second antenna apparatus 20 is used for transmission/reception with respect to a wireless wide area network (WAN), and includes, for example, one monopole antenna element or a folded monopole antenna element. A third RF cable 6 is routed from a feed terminal for this antenna element in the same direction to the first and second RF cables 4 and 5 so as to be parallel to them. The third RF cable 6 is wired along the side portion 54 of the upper housing 52 and is then connected to the second radio circuit 40.

With this arrangement, the MIMO antenna apparatus 10 is disposed at a position near an end portion of the upper side portion 53 of the upper housing 52, and the second antenna apparatus 20 is disposed near the middle of the upper side portion 53 of the upper housing 52. When routing out the first and second RF cables 4 and 5 of the MIMO antenna apparatus 10, therefore, it is possible to wire the cables 4 and 5 without making them pass over the second antenna apparatus 20. This can prevent the second antenna apparatus 20 from being influenced by the first and second RF cables 4 and 5, thereby suppressing the occurrence of unnecessary resonance in the second antenna apparatus 20.

Figure 10:
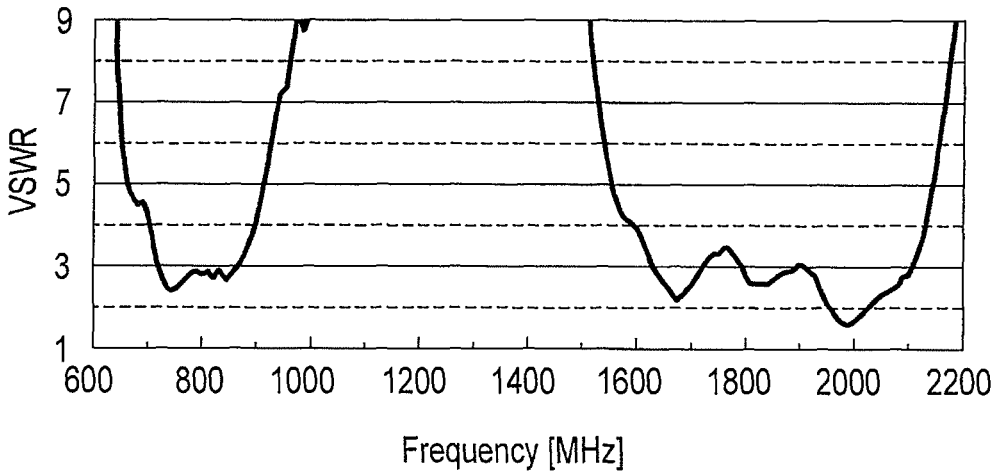
FIG. 10 is a graph showing the VSWR characteristics of the second antenna apparatus which are obtained by the electronic device shown in FIG. 9.
Figure 11:
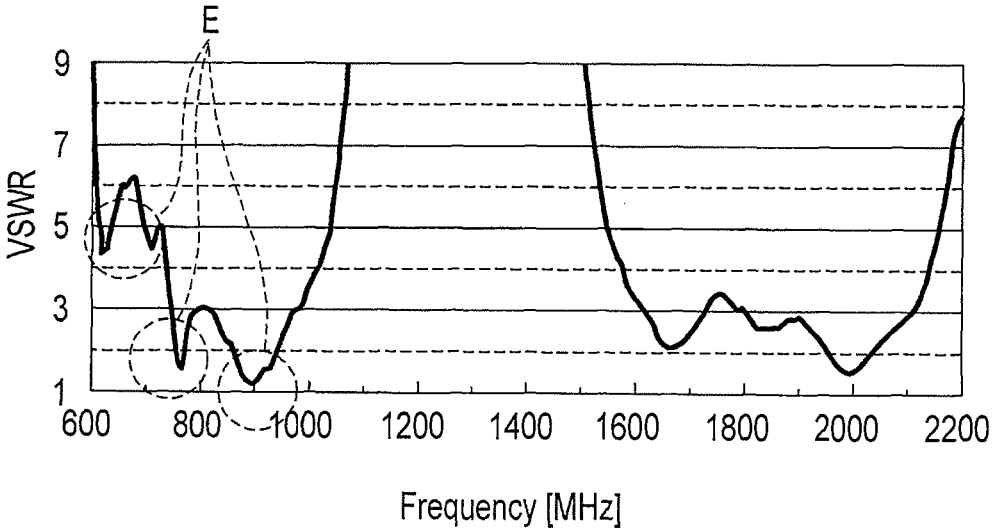
FIG. 11 is a graph showing the VSWR characteristics of the second antenna obtained by a reference example with the RF cables of a MIMO antenna being arranged on the second antenna apparatus.

FIG. 10 shows an example of the VSWR characteristic of the second antenna apparatus 20 according to the first embodiment. As is obvious from FIG. 10, the occurrence of unnecessary resonance is suppressed in a frequency band (800-MHz band). FIG. 11 shows, as Reference Example, the VSWR characteristics of the second antenna apparatus 20 in which the MIMO antenna apparatus 10 is disposed near the middle of the upper side portion 53, and the second antenna apparatus 20 is disposed near an end portion of the upper side portion 53, with the first and second RF cables 4 and 5 of the MIMO antenna apparatus 10 being wired so as to pass over the second antenna apparatus 20. As is obvious from the characteristics, unnecessary resonances E occur in a low-frequency band (800-MHz band) because of the influences of the first and second RF cables 4 and 5. When the unnecessary resonances E occur, it is difficult to satisfy desired radiation characteristics in an 800-MHz band in a wireless WAN. As a result, a radio signal may not pass the authentication procedure laid down by a radio carrier.

OTHER EMBODIMENTS

The above embodiments have exemplified the case in which wireless LAN signals are received. A target system may be the one which receives signals transmitted from other systems such as a terrestrial digital radio broadcasting system and a municipally-managed disaster prevention broadcasting system.

In addition, the above embodiments can be executed by variously modifying the types, numbers, arrangements, and sizes of antenna elements constituting the first and second antenna apparatuses. Furthermore, the above embodiments can be executed by variously modifying the disposition positions of the first and second antenna apparatuses, the directions in which RF cables are routed out, and the like.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. An antenna apparatus in an electronic device comprising a radio circuit and a ground pattern, the apparatus comprising:

a first antenna unit along a side of the ground pattern and configured to resonate in one of a first frequency band and a second frequency band;

a second antenna unit along the side of the ground pattern, juxtaposed with the first antenna unit and configured to resonate in the second frequency band;

a first radio frequency (RF) cable configured to connect the first antenna unit and the radio circuit; and a second RF cable configured to connect the second antenna unit and the radio circuit, wherein the first RF cable and the second RF cable are routed from the first antenna unit and the second antenna unit in an arrangement direction of the first antenna unit and the second antenna unit so as to be parallel to each other, and a part of the first RF cable is over the ground pattern, and wherein a position at which the second antenna unit is in contact with the ground pattern is set at a position set back from a position at which the first antenna unit is in contact with the ground pattern, and the first RF cable is over a region formed by setting back the second antenna unit.

2. The antenna apparatus of claim 1, wherein the first frequency band is lower than the second frequency band.

3. The antenna apparatus of claim 1, wherein the second antenna unit comprises a second antenna element having one end connected to the second RF cable at a second feed point, and the other end open, the first antenna unit comprises a first antenna element having one end connected to the first RF cable at a first feed point, and the other end open, and a parasitic element having one end connected to the ground pattern between the first feed point and the second feed point, and the other end open, and the parasitic element is capacitively coupled to the first antenna element.

4. The antenna apparatus of claim 1, wherein the ground pattern comprises a first portion, a second portion projected from the first portion to the first RF cable, and a third portion projected from the second portion to the second RF cable, a part of the first RF cable is over the second portion, and a part of the second RF cable is over the third portion.

5. The antenna apparatus of claim 4, wherein the second antenna unit is at a first side of the first antenna unit in a first direction, the first RF cable is routed from a first feeding point in the first direction, the second RF cable is routed from a second feeding point in the first direction, the second portion is at the first side of the first feeding point in the first direction, and the third portion is at the first side of the second feeding point in the first direction.

6. The antenna apparatus of claim 1, wherein the first antenna unit is configured to resonate in the first frequency band.

7. The antenna apparatus of claim 6, wherein the first antenna unit is configured to resonate in the first frequency band and the second frequency band.

8. The antenna apparatus of claim 1, wherein an open end of the first antenna unit directs to a second direction, and an open end of the second antenna unit directs to a third direction which is opposite to the second direction.

9. An electronic device comprising:

a housing;

a first radio circuit;

a ground pattern;

a first antenna apparatus, the first antenna apparatus comprising:

a first antenna unit along a side of the ground pattern and configured to resonate in a first frequency band and a second frequency band;

a second antenna unit along the side of the ground pattern juxtaposed with the first antenna unit and configured to resonate in the second frequency band;

a first radio frequency (RF) cable configured to connect the first antenna unit and the first radio circuit; and a second RF cable configured to connect the second antenna unit and the first radio circuit, a second antenna apparatus configured to resonate in a third frequency band lower than both the first frequency band and the second frequency band;

a second radio circuit; and a third RF cable configured to connect the second antenna apparatus and the second radio circuit, wherein the first RF cable and the second RF cable are routed from the first antenna unit and the second antenna unit in an arrangement direction of the first antenna unit and the second antenna unit so as to be parallel to each other, and the first RF cable is over the ground pattern, wherein the first antenna apparatus is disposed on a first side portion of the housing at an end portion, the second antenna apparatus is disposed on a first side portion of the housing at a position closer to a middle of the first side portion than a position of the first antenna apparatus, the first RF cable and the second RF cable are routed from the first antenna apparatus in a direction opposite to a direction in which the second antenna apparatus is disposed, the third RF cable is routed out in a direction in which the first antenna apparatus is disposed, and the first RF cable, second RF cable, and third RF cable pass through a second side portion adjacent to the first side portion of the housing so as to be parallel to each other, and are all connected to the first radio circuit and the second radio circuit.

10. The electronic device of claim 9, wherein the first frequency band is lower than the second frequency band.

11. The electronic device of claim 9, wherein the second antenna unit comprises a second antenna element having one end connected to the second RF cable at a second feed point, and the other end open, and the first antenna unit comprises a first antenna element having one end connected to the first RF cable at a first feed point, and the other end open, and a parasitic element having one end connected to the ground pattern between the first feed point and the second feed point, and the other end open, and the parasitic element is capacitively coupled to the first antenna element.

12. An electronic apparatus comprising:

an antenna apparatus comprising a first antenna unit, a second antenna unit, and a ground pattern;

a radio circuit electrically coupled to the first antenna unit through a first cable and electrically coupled to the second antenna unit through a second cable; and a housing comprising the antenna apparatus and the radio circuit, wherein the first antenna unit is at a side of the ground pattern, a second antenna unit is at the side of the ground pattern and oriented in a first direction from the first antenna unit, the ground pattern comprises a main portion, a first portion projected from the main portion toward the first antenna unit and the second antenna unit, and a second portion projected from the first portion toward the second antenna unit, a portion of the first cable and a portion of the second cable which are electrically coupled to the first antenna and the second antenna are routed in the first direction;

the portion of the first cable is positioned over the first portion and the portion of the second cable is positioned over the second portion.

13. The electronic apparatus of claim 12, wherein the first antenna unit resonates at one of a first frequency and a second frequency and the second antenna unit resonates at the second frequency.

14. The electronic apparatus of claim 13, wherein the first antenna unit resonates at the first frequency and the second frequency; and the first frequency is lower than the second frequency.

15. The electronic apparatus of claim 12, wherein the second antenna unit comprises a second antenna element having one end connected to the second cable at a second feed point, and the other end open, the first antenna unit comprises a first antenna element having one end connected to the first cable at a first feed point, and the other end open, and a parasitic element having one end connected to the ground pattern between the first feed point and the second feed point, and the other end open, and the parasitic element is capacitively coupled to the first antenna element.

16. The electronic apparatus of claim 15, wherein the first RF cable is routed from the first feeding point in the first direction, the second RF cable is routed from the second feeding point in the first direction, the first portion is at the first side of the first feeding point in the first direction, and the second portion is at the first side of the second feeding point in the first direction.

17. The electronic apparatus of claim 15, wherein the open end of the first antenna element directs to a second direction, and the open end of the second antenna element directs to a third direction which is opposite to the second direction.

* * * * *